United States Patent [19]

Gaugel

[11] Patent Number: 4,722,039

[45] Date of Patent: Jan. 26, 1988

[54] SHADED BEAM VEHICULAR DISCHARGE-TYPE HEAD LAMP

[75] Inventor: Manfred Gaugel, Fürstenfeldbruck, Fed. Rep. of Germany

[73] Assignee: Patent Treuhand Gesellschaft für elektrische Glühlampen mbH, Munich, Fed. Rep. of Germany

[21] Appl. No.: 5,685

[22] Filed: Jan. 21, 1987

[30] Foreign Application Priority Data

Feb. 6, 1986 [DE] Fed. Rep. of Germany ..... 3603743

[51] Int. Cl.[4] ..... F21V 7/12; H01J 61/02

[52] U.S. Cl. ..... 362/296; 362/61; 362/226; 362/263; 313/15; 313/113

[58] Field of Search ..... 313/113, 318, 15; 362/61, 80, 214, 226, 263, 296

[56] References Cited

U.S. PATENT DOCUMENTS 4,140,385 2/1979 Shaw et al. ..... 355/3 R
4,423,348 12/1983 Greiler ..... 313/113
4,623,815 11/1986 Krieg et al. ..... 313/113
4,626,734 12/1986 Greiler ..... 313/51
4,658,184 4/1987 Gáspár ..... 315/47

FOREIGN PATENT DOCUMENTS 1597981 11/1969 Fed. Rep. of Germany ..... 362/214
593079 5/1959 Italy ..... 362/214

*Primary Examiner*—Samuel Scott
*Assistant Examiner*—Allen J. Flanigan
*Attorney, Agent, or Firm*—Frishauf, Holtz, Goodman & Woodward

[57] ABSTRACT

To control the light distribution of light emitted from a high-pressure discharge bulb (1) asymmetrically, to meet automotive head lamp legal and design requirements, a single unitary combination bulb holder and light distribution element (11) is secured to the base sleeve (4) for example by plastic rivets (8) securing a unitary bottom plate (9) to an alignment body (5, 6) which, in turn, is positioned in the base in predetermined relation to a base positioning ring (15) formed thereon. The light distribution body is trough-shaped, with the concave surface (14) facing the bulb, and extends parallel thereto.

12 Claims, 2 Drawing Figures

SHADED BEAM VEHICULAR DISCHARGE-TYPE HEAD LAMP

Reference to related application, assigned to the assignee of the present application, the disclosure of which is hereby incorporated by reference: U.S. Ser. No. 5,684, filed Jan. 21, 1987, Eckhardt et al.

The present invention relates to high-pressure discharge lamps, and more particularly to a high-pressure discharge lamp suitable for automotive use.

BACKGROUND

The high light output per input power (lumens per watt) of discharge lamps makes it desirable to consider such lamps also for automotive head lamp use. One such type lamp uses a double-ended bulb, in elongated form, with current supply leads emanating from both and portions of the bulb. The lamp, additionally, includes a hollow base structure with terminal tabs, posts or blades, and a holder element for the lamp bulb itself. Additionally, the lamp includes a shielding element to obtain the unsymmetrical light distribution required by automotive standards.

Two-filament incandescent lamps used in automotive head lamps frequently include a shielding cap, located within the light bulb, in order to obtain the required light distribution from the two respective filaments, one for "high beam" and one for "low beam". Head lamps which are specifically designed to provide low-beam illumination only usually have a light shield located outside of the lamp bulb. Such a light shield may be associated with the reflector of the head light or with the socket of the lamp itself.

THE INVENTION

It is an object to provide a high-pressure discharge lamp suitable for automotive use in which a light shield is secured to the base of the lamp located outside of the bulb itself, while permitting use of the bulb suitable for high-pressure discharge operation. The overall construction, further, should be simple, while utilizing materials which can accept the high pulse voltages required to ignite or fire a high-pressure discharge lamp, particularly when the lamp is already under hot condition.

Briefly, the elongated light bulb is retained on the socket by a holder and, in accordance with the present invention, the holder is so shaped that it, simultaneously, functions as the light directing element or, in other words, as the light distribution control element.

In accordance with a feature of the invention, the holder is a composite of an electrically insulating, high-temperature resistant material, for example a ceramic, formed to receive or engage with attachment and engagement elements for the bulb and for the base, respectively. The shield or light distribution control structure and the holder may be a unitary element made of plastic material. In accordance with a preferred feature of the invention, however, and for better high-temperature resistance, freedom from gassing, and high-voltage insulation, it is desirable to form the light distribution control element of ceramic, particularly when the light source is a high-pressure discharge lamp.

In accordance with a feature of the invention, the light distribution control element is a generally longitudinal, somewhat trough-shaped or channel-shaped structure with a plate at one end formed thereon perforated with holes, which are penetrated by plastic projections, pins or stubs secured to or forming part of the lower portion of the bulb holder, the stubs being riveted over the ceramic plate, for example by ultrasonic riveting or other suitable deformation.

The light distribution control element itself generally is trough-shaped with the concave side facing the lamp. The trough may be essentially or substantially part-circular in cross section, with a longitudinal axis which is congruent with the longitudinal axis of the lamp bulb. The angular extent of the trough is preferably less than 180° and, desirably, about 165°. A 165° angle results in the required asymmetrical light-dark limit defined by automotive standard lighting requirements.

DRAWINGS

FIG. 1 is an upright side view, partly cut away and in section, of a lamp, with the holder element; and FIG. 2 is a top view of the lamp of FIG. 1.

DETAILED DESCRIPTION

Figure 1:
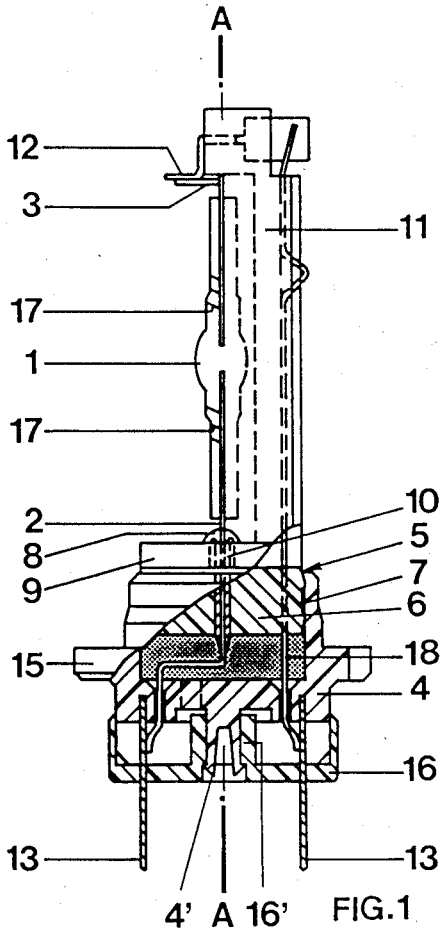

The lamp illustrated is a high-pressure discharge lamp, and includes a bulb 1 and two current supply leads 2, 3 passing through end pinch or press seals to form a double-ended elongated bulb structure. The lamp is secured in a holder element 5, which can be located in adjusted position with respect to a base sleeve 4. The relative adjustment of the position of the lamp bulb 1 with respect to the base sleeve 4 can be done automatically and optically, in accordance with well known servo technology, so that the light distribution pattern, with respect to a reference defined by the base sleeve 4, will be in accordance with engineering and legal requirements.

The holder element 5 for the lamp is made of a slightly barrel-shaped body 6 of plastic material. At its thickset circumference, the body 6 is surrounded by a ring 7 of ferromagnetic material, recessed in a circumferential groove. The holder element 5, together with the barrel-shaped body 6, is fitted in a cylindrical opening of the base sleeve 4. Base sleeve 4 likewise is made of plastic. The position of the bulb 1 can be changed with respect to the base sleeve 4 due to the shape of the body 6, since slight relative movement in three dimensions with respect to the base sleeve 4 is possible. After the lamp 1 is precisely optically aligned with respect to the base sleeve structure 4, the holder 5 defined by the barrel body 6 and the ferromagnetic ring 7 are subjected to high-frequency heating; this melts the plastic material in the region of the metal ring 7 and will form a tight, precisely adjusted connection between the elements 5 and 4, so that the lamp bulb 1 and holder 4 are exactly optically aligned. Details of this construction are described and claimed in the copending referenced application Ser. No. 5,684 filed Jan. 21, 1987. Eckhardt et al.

In accordance with a feature of the invention, projecting stubs, pins or bolt elements 8 are formed on the body 6 of the holder element 5, projecting upwardly towards the direction of the bulbous portion of the bulb 1. A plate 9, formed with suitable openings to receive the stubs 8, is seated on the end surface of the body 6 of the element 5; the stubs 8 are passed through the openings in the plate 9 and then riveted over—see FIG. 1.

The plate 9 is formed with a further opening 10, which permits passage of the current supply lead 2 of the lamp therethrough, and attachment of the current supply lead 2 therein. The lamp, additionally, is retained in position by an upwardly extending elongated element 11, secured to or, preferably, integral with the plate 9. The element 11 is made of insulating material and extends parallel to the lamp axis A—A (FIG. 1). If the lamp is a high-pressure discharge lamp, the operating temperatures of the lamp may be high—several hundred degrees C. and, hence, plate 9 and element 11 are preferably a unitary ceramic element. The free end of element 11, that is the upper end in FIG. 1, carries a contact terminal 12 to which the second current supply lead 3 of the bulb 1 is attached, for example by welding.

A connection 18 is placed between the second current supply lead 3 of the lamp 1 and a base terminal 13. The connection 18 is preferably passed through or fitted into the element 11, at the side remote from the lamp bulb 1.

The lamp bulb 1, and, especially, the regions from the bulb towards the press or pinch seal ends, may be surrounded with a heater wire 17 in order to accelerate starting of the lamp 1. One connecting wire 17′ is shown, connected to the heater 17, also located along the elongated element 11, and at the outside thereof. The second terminal of the heater 17 may be connected, if desired, to one of the lamp terminals 13, or otherwise connected to a separate terminal in a suitable manner. If connected by a separate wire, it also is preferably located on the side of the element 11 or on the surface remote from the lamp bulb 1.

Figure 2:
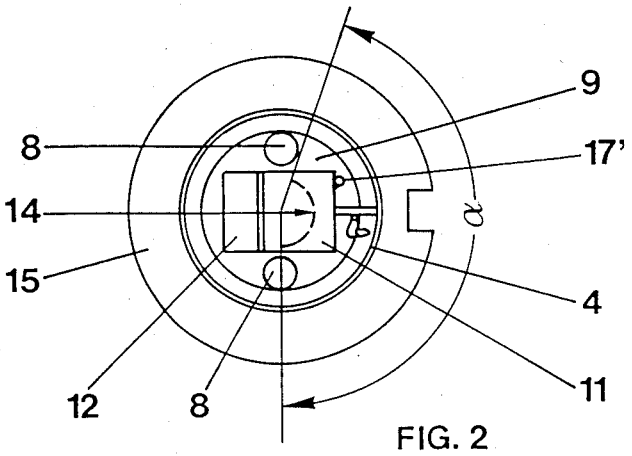

In accordance with a feature of the invention, the elongated element 11 forms the holder structure for the second connecting terminal 3 of the lamp and at the same time the light distribution control element or light shield. Referring to FIG. 2, the element 11, at the inside thereof, is concave, with an asymmetrically positioned depression side 14, extending over an angle $\alpha$ of 165°. Of course, different light distribution may be obtained by changing the angle if a lamp of the construction described is used for purposes other than vehicular road illumination.

The base of the lamp includes the holder 5, the base sleeve structure 4, and a preferably unitary adjustment or holder ring 15. Blade terminals 13 are likewise secured to the base sleeve 4, for example seated therein. A cover cap 16 closes off the lower portion of the base sleeve 4. The cover cap 16, preferably, is made of plastic and plastic-welded to the base sleeve 4.

The holder 5 with the barrel-shaped body 6 is fitted in the opening of the base sleeve 4 which is cylindrical to receive the body 6. The two elements 4, 6 cooperate in the manner of a ball joint and, after alignment of the light distribution from the bulb 1, are then secured together. The bottom of the base sleeve 4 is formed with openings or bores of a diameter just slightly larger than the current supply leads 2 and/or the connecting wires 18, or the connecting wire 17′ for connection to the terminal blades 13. The wire 17′ can be connected to a further terminal blade, not shown, as well known.

The blade terminals 13 are securely retained within the bottom of the base sleeve 4 at the side remote from the bulb 1; the current supply leads 2, 3, 18 and 17′ to the respective terminal blades 13 are positioned just below—with reference to FIG. 1—the lower surface of base 4. The connecting joints, for example weld connections, are protected against the outside, ingress of moisture and the like, by the cap 16.

High-voltage flash-over between the current-carrying elements 2, 13, 17, 17′ and 18 is effectively avoided by filling all free spaces formed by the holder 5, the base sleeve 4, and between base sleeve 4 and cover cap 16 with a silicone resin. Alternatively, or in addition thereto, insulating ribs or walls may be formed in the base sleeve 4 and/or on the cap 16, as shown at 16′, in order to provide for electric insulation and mechanical isolation of the currentcarrying elements. The walls 16′ may, additionally, be formed with a small snap shoulder to snap within a snap extension 4′ formed on the base 4, thereby facilitating assembly and preventing inadvertent loosening of the respectively separate components.

Various changes and modifications may be made within the scope of the inventive concept.

I claim:

1. Automotive head lamp, particularly high-pressure discharge head lamp, having an elongated lamp bulb (1);

a pair of electrodes extending outwardly of said bulb from terminal ends thereof and inwardly of the bulb towards an intermediate region thereof, said electrodes being sealed into said terminal ends;

a base sleeve (4) secured to one end of the lamp;

a bulb holder (5) secured to the base sleeve (4);

at least two base terminals (13, 13) being respectively electrically connected to the electrodes;

means for holding the other end of the bulb in position such that the elongated bulb extends axially from the base; and light distribution control means in the form of a shield element (11) made of electrically insulating high-temperature resistant material for controlling the direction and distribution of light emitted from the lamp, wherein the shield element (11) comprises an elongated trough or groove element, the concave or groove side (14) of which is directed to face the lamp bulb, and a support plate (9) attached to the shield element (11) is connected to the bulb holder (5) by connection means (8), and wherein the light distribution and control means form part of said means (5) for holding the other end of the lamp bulb in position.

2. The lamp of claim 1, wherein the shield element (11) comprises ceramic.

3. The lamp of claim 1, wherein said connection means comprise plastic rivets (8) extending through the plate (9).

4. The lamp of claim 1, wherein the concave or groove axis of the shield element (11) coincides with the longitudinal axis (A—A) of the lamp bulb.

5. The lamp of claim 1, wherein the angular extent of the concave or groove side (14) of the shield element (11) forms an angle ($\alpha$) less than 180°.

6. The lamp of claim 1, wherein the angular extent of the concave or groove side (14) of the shield element (11) forms an angle ($\alpha$) of about 165°.

7. The lamp of claim 1, further including a connecting lead (18) extending between at least one of the base terminals (13) and the electrode (3) located remote from the base sleeve, said connecting lead being guided longitudinally along the light distribution and control means.

8. The lamp of claim 1, wherein the bulb is a high-pressure discharge bulb (1);

a heater winding (17) is provided, wound around at least part of said high-pressure discharge bulb;

and at least one connecting lead (17′) extending longitudinally of the light distribution control means and connected to a terminal of said heater.

9. The lamp of claim 7, wherein said shield element comprises a body of insulating material formed with a recess;

and wherein said connecting lead (18) is positioned in said recess.

10. The lamp of claim 8, wherein said shield element comprises a body of insulating material formed with a recess;

and wherein said heater connection (17') is positioned in said recess.

11. The lamp of claim 8, wherein said shield element comprises a body of insulating material formed with a first and a second recess;

wherein said heater connection (17') is positioned in said first recess;

and a connection lead (18) is provided, connected to the lamp electrode (3) remote from the base and one of said base terminals (13) and located, at least in part, in said second recess.

12. The lamp of claim 1, wherein said lamp bulb (1) comprises a high-pressure discharge lamp;

and wherein said shield element comprises an elongated ceramic trough-shaped structure extending axially from said base, with the concave region of the trough facing the lamp bulb, and having an opening angle ($\alpha$) of less than 180°.

* * * * *